US005699030A

United States Patent [19]

Leikus et al.

[11] Patent Number: 5,699,030

[45] Date of Patent: Dec. 16, 1997

[54] MAGNETICALLY ACTIVATED RF SWITCH INDICATOR

[75] Inventors: Vincent Leikus, Fairfield, Conn.; Yuly Bauer, Brooklyn, N.Y.

[73] Assignee: The Narda Microwave Corporation, Hauppauge, N.Y.

[21] Appl. No.: 627,288

[22] Filed: Apr. 4, 1996

[51] Int. Cl.[6] ..... H01H 53/04

[52] U.S. Cl. ..... 335/4; 335/151; 335/205; 333/105; 340/644

[58] Field of Search ..... 335/151–3, 205–7, 335/4–5; 333/105–8; 340/644

[56] References Cited

U.S. PATENT DOCUMENTS 4,479,117 10/1984 Marquardt ..... 335/2

4,633,201 12/1986 Ruff ..... 335/4

*Primary Examiner*—Lincoln Donovan

*Attorney, Agent, or Firm*—Brumbaugh, Graves, Donohue & Raymond

[57] ABSTRACT

An electromagnetic relay, such as an electromechanical RF switch, which is operated by an electromagnetic coil, is provided with an indicating circuit which responds to the position of the electromagnetic armature as well as the application of driving current to the coil. A magnetically activated reed switch is mounted adjacent to the electromagnetic coil at a distance selected so that the magnetic field of the coil will operate the reed switch when current is applied to the coil and the armature is driven into a position closing a magnetic circle.

8 Claims, 1 Drawing Sheet

MAGNETICALLY ACTIVATED RF SWITCH INDICATOR

BACKGROUND OF THE INVENTION

This invention relates to electromechanical relays, and particularly to electromechanical RF switches having switch position indicators.

Prior RF electromechanical switches have been provided with switch position indicators which are responsive to the application of current to the coil of an electromagnet which operates the switch. While such arrangements are effective when the switch is properly functioning, they do not provide an actual indication of switch operation under certain conditions, i.e., when the switch fails to operate because of an open circuit or short circuit in the electromagnet drive or when the armature is mechanically jammed and cannot be moved into the switched position by the electromagnet.

It is therefore an object of the invention to provide an electromechanical relay or RF switch with an indicator circuit that responds to the magnetic field of the electromagnet when the armature moves into the switched position to thereby provide a more reliable indication of the condition of the relay or switch.

SUMMARY OF THE INVENTION

In accordance with the invention there is provided an electromechanical relay having an armature driven by an electromagnet between first and second positions. The armature is mechanically coupled to at least one contact member. A magnetically activated reed switch is arranged adjacent to the electromagnet and operated by magnet fields from the electromagnet when current is provided to the electromagnet and the armature is in the second position.

In a preferred embodiment the relay is an electromagnetic RF switch. When driven into the second position, the armature is preferably arranged to close a magnetic circuit, directing magnetic field from the electromagnet toward the reed switch.

For a better understanding of the present invention together with other and further objects thereof, reference is made to the following description, taken in conjunction with the accompanying drawings, and its scope will be pointed out in the appended claims.

DESCRIPTION OF THE PREFERRED EMBODIMENT

Figure 1:
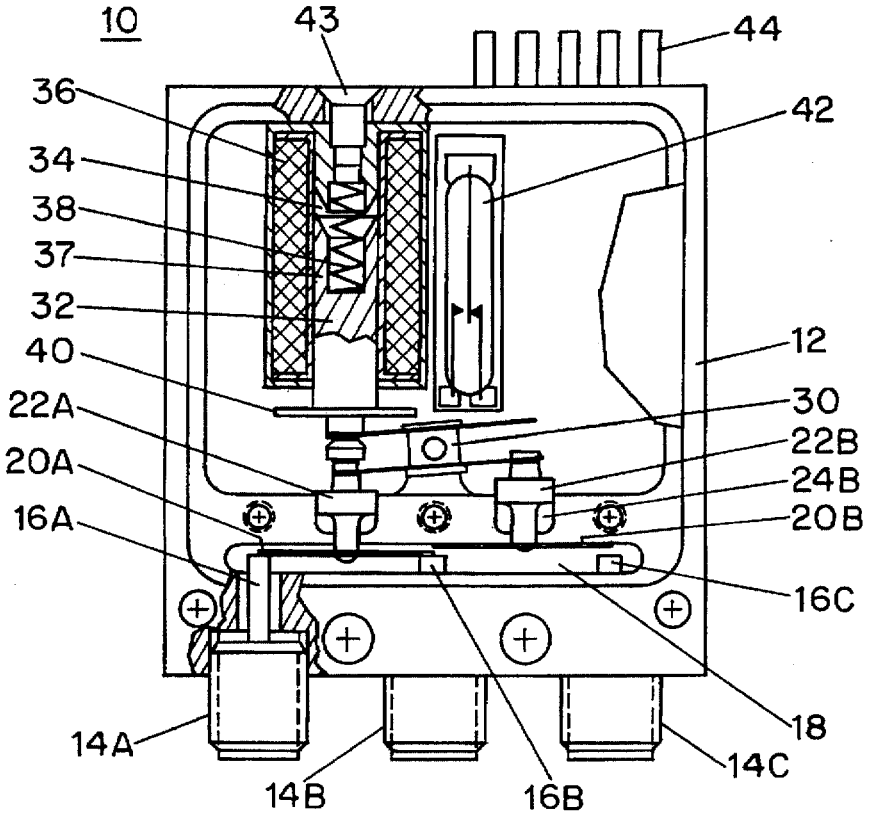
FIG. 1 is a partial cross-sectional view of a single pole, double throw RF switch in accordance with the present inventions the unswitched condition.
Figure 2:
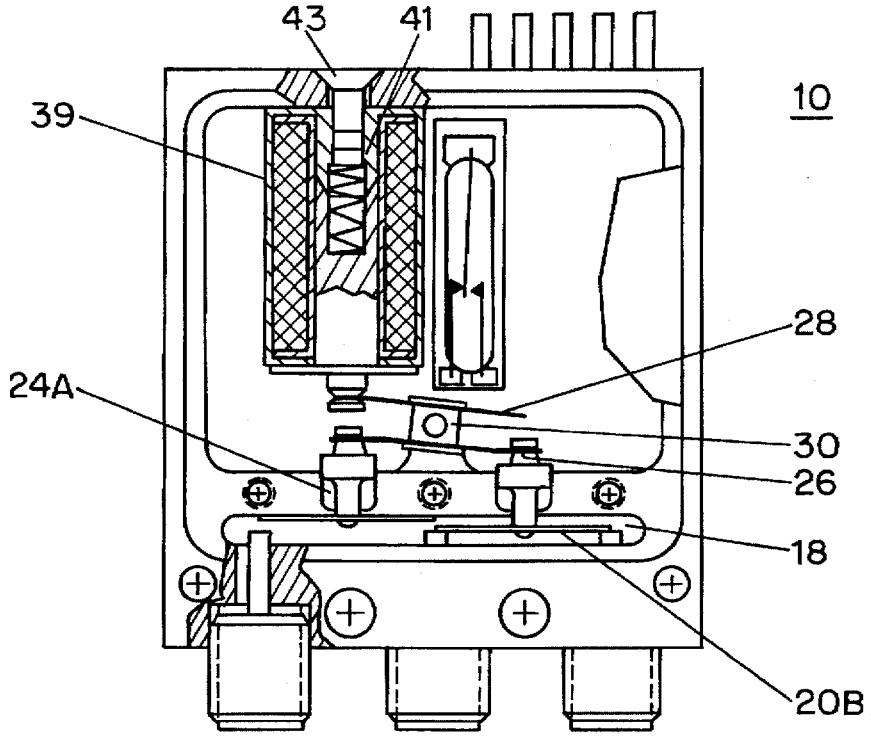
FIG. 2 is a partial cross-sectional view of the FIG. 1 switch in the switched condition.

Referring to FIGS. 1 and 2, there is shown a view of an electromechanical RF switch 10 in accordance with the invention. Switch 10 includes a housing 12, the cover of which has been removed in the drawings so that interior components can be viewed. Switch 10 has three RF ports having standard connectors 14A, 14B and 14C, such as "type SMA" coaxial connectors. The inner conductor 16A, 16B and 16C of connectors 14 extend into an RF cavity 18, wherein the upper end of each inner conductor 16C forms a switch contact.

RF cavity 18 includes two contact leaf members 20A and **20*b*, which move into and out of contact with the switch contacts of inner conductors 16A, 16B and 16C to effect RF switching, as will be described. Contact leaf members 20A and 20B are carried respectively on dielectric push rods 22A and 22B respectively. Push rods 22A and 22B are received in stepped bores 24A and 24B in housing 12 and arranged to move vertically therein. The upper end of push rods 22A and 22B are received in forked ends of lower leaf spring 26, which together with upper leaf spring 28 is mounted on a rocker assembly 30, arranged to pivot on a horizontal axis. Upper leaf spring 28 has a forked end received on the lower end of armature 32, which is generally cylindrical in shape and extends into a cylindrical central passage 34 of cylindrical electromagnet coil 36. Coil 36 includes a ferromagnetic jacket 39 and upper ferromagnetic pole 41 having a threaded central bore by which the entire coil assembly is mounted to housing 12 by screw 43. Spring 38 urges armature 32 downward and out of coil 36. Coil 36 is wound on spool 37, which may be fabricated of aluminum and coated with teflon to provide lubrication to movement of armature 32 and improved high voltage insulation for the windings of coil 36**.

When no current is applied to coil 36, armature 32 is urged downwardly in to a first position by spring 38, as shown in FIG. 1. In this first position rocker assembly 30 is pivoted counterclockwise by the action of armature 32 acting on the left end of upper leaf spring 28. The pivoting of rocker assembly 30 causes lower leaf spring 26 to push push rod 22A downward until contact leaf member 20A engages switch contacts of inner connectors 16A and 16B, forming an RF path between connector ports 14A and 14B, which are the "normally closed" ports of the switch. The counterclockwise pivoting of rocker assembly 30 also causes lower leaf spring 26 to pull push rod 22B upward until contact leaf member 20B rests against the upper wall of RF cavity 18, providing high RF isolation between connector ports 14B and 14C, which are the "normally open" ports.

The arrangement of rocker assembly 30 with upper leaf spring 28 and lower leaf spring 26 enables the contact leaf members 20 to engage inner conductor 16 with a wiping action and prevents excess mechanical loading on contact leaf members 20.

When current is applied to coil 36, armature 32 is pulled upwardly to a second position by magnetic force, until flange 40 rests against coil jacket 39, forming a closed magnetic circuit which includes ferromagnetic armature 32, ferromagnetic coil jacket 39 and ferromagnetic pole piece 41. The upward movement of armature 32 causes rocker assembly 30 to pivot clockwise, thereby causing lower leaf spring 26 to pull push rod 22A upward until contact leaf member 20A rests against the upper wall of RF cavity 18 and causing the opposite end of lower leaf spring 26 to push push rod 22B downward until contact leaf member 20B engages switch contacts of inner conductors 16B and 16C, thereby forming an RF path between ports 14B and 14C and isolating ports 14A and 14B, as shown in FIG. 2.

Magnetically operated read switch 42 is arranged along a side of coil 36 at a distance selected to cause the magnetic field of coil 36 to operate reed switch 42 when armature 32 is in the second position and current is supplied to coil 36. In particular, when armature 32 is in the lower position, as shown in FIG. 1, the magnetic circuit formed by jacket 39, pole piece 41 and armature 32 around coil 36 is open by air gaps between jacket 39 and flange 40 and between pole piece 41 and armature 32. When current is applied and armature 32 moves to its second position, as shown in FIG. 2, while the magnetic circuit is being closed, there is a resulting increase of the magnitude of magnetic flux in jacket 39 adjacent reed switch 42. With the increased flux, sufficient leakage magnetic field is applied to the reed switch 42 to change the contact thereof. The contacts from the reed switch 42 are made available at terminals 44 to provide a remote indication of the condition of switch 42 and hence the condition of armature 32.

Accordingly, a remote indication can be provided of not only the application of current to coil 36, but also the activated position of armature 32.

It will be apparent to those skilled in the art that indication of the position of the armature 32 can be provided through either the normally open or normally closed contacts of reed switch 42, which can be appropriately wired to terminals 44, which also provides driving circuit for coil 36. While there has been described what is believed to be the preferred embodiment of the invention with respect to signal pole, double throw RF switch, those skilled in the art will recognize that the invention can be applied to other types of electromagnetic relays and other types of electromechanical RF switching devices without departing from the spirit of the invention, and it is intended that the following claims will address all such devices as fall with the true scope of the invention.

We claim:

1. An electromechanical relay comprising an electromagnet, an armature driven by said electromagnet between a first and a second position with respect thereto, said armature being mechanically coupled to at least one contact member, and a magnetically activated reed switch arranged adjacent to said electromagnet, said reed switch having a first switch position and a second switch position and being operated to said second switch position by magnetic fields from said electromagnet only when current is provided to said electromagnet and said armature is in said second position.

2. A relay as specified in claim 1 wherein said electromagnet comprises a cylindrical coil having a cylindrical central passage and wherein said armature comprises a cylinder of ferromagnetic material arranged to be drawn to said second position in said central passage, said armature being arranged to close a magnetic circuit when in said second position.

3. A relay as specified in claim 2 wherein closing of said magnetic circuit directs magnetic field from said electromagnet toward said reed switch.

4. A relay as specified in claim 2 wherein said reed switch is arranged along a side of said cylindrical coil.

5. An electromechanical RF switch having an indicator circuit for signaling the condition of said switch, said switch comprising an electromagnet, an armature driven by said electromagnet between a first and a second position and urged by a spring from said second to said first position, said armature being coupled to at least one contact member for making electrical connection between RF terminals when said armature is in one of said first or second positions, said indicator circuit comprising a reed switch ganged adjacent said electromagnet, said reed switch having a first switch position and a second switch position and operated to said second switch position by magnetic fields from said electromagnet only when current is provided to said electromagnet and said armature is in said second position.

6. An RF switch as specified in claim 5 wherein said electromagnet comprises a cylindrical coil having a cylindrical central passage and wherein said armature comprises a cylinder of ferromagnetic material arranged to be drawn into said second position in said central passage against said spring, said armature being arranged to close a magnetic circuit in said second position.

7. A RF switch as specified in claim 6 wherein closing of said magnetic circuit directs magnetic field from said electromagnet toward said reed switch.

8. A RF switch as specified in claim 7 wherein said reed switch is arranged along a side of said cylindrical coil.

* * * * *